United States Patent [19]

Lin

[11] Patent Number: 4,627,315

[45] Date of Patent: Dec. 9, 1986

[54] SOCKET WRENCH WITH ATTACHABLE SOCKET STORAGE MEANS IN HANDLE

[76] Inventor: Patrick Lin, 12th Fl., No. 1034, Min Sheng East Rd., Taipei, Taiwan

[21] Appl. No.: 751,209

[22] Filed: Jul. 2, 1985

[51] Int. Cl.[4] ..... B25G 1/08

[52] U.S. Cl. ..... 81/177.4; 81/490; 81/60

[58] Field of Search ..... 81/490, 177.4

[56] References Cited

U.S. PATENT DOCUMENTS

| | | | |
|---|---|---|---|
| 1,596,951 | 8/1926 | Smith | 81/177.4 |
| 4,253,356 | 3/1981 | Martinmaas | 81/177.4 |
| 4,302,990 | 12/1981 | Chrichton et al. | 81/177.4 |

*Primary Examiner*—James G. Smith

*Attorney, Agent, or Firm*—Burns, Doane, Swecker & Mathis

[57] ABSTRACT

In socket wrench of the present invention there is provided a storage cavity in the handle thereof for housing an attachable socket storage means or holder. Socket holder comprises a side plate and a cover plate being linked to each other in a L-shaped arrangement, the side plate having mid longitudinal portion thereof formed into a narrow and elongate guide slot for engagement and movement therein of a plurality of mounting stubs. Each stub is to receive a socket member to be mounted thereon. Prior to use of the socket wrench, socket holder can be drawn out therefrom, thereby reducing the weight in the handle advantageous to the manipulation of the wrench, and the upstanding disposition of the socket members of various sizes inside the holder allows removal of one socket member from the other members even more conveniently.

4 Claims, 5 Drawing Figures

SOCKET WRENCH WITH ATTACHABLE SOCKET STORAGE MEANS IN HANDLE

BACKGROUND OF THE INVENTION

The present invention relates to a socket wrench having a set of interchangeable sockets stored for use and, more particularly, a socket wrench structure which includes a storage cavity in the handle for reception of a socket storage means or socket holder having interchangeable sockets mounted therein.

A socket wrench with a facility for storing a set of interchangeable sockets was disclosed, for example, in U.S. Pat. No. 4,352,306 to Martinmaas. In the disclosed type of socket wrench, a storage cavity is defined in the metal shell, the handle of the wrench, where individual sockets are stored and are embraced each by a retaining strap. When a set of sockets are stored in the cavity or one or two sockets are detached therefrom, this would unavoidably make the manipulation of the wrench less handy owing to the added weight of the sockets in the former case and the vacant space left over by the removal of the sockets in the latter. In addition, when one or the other socket is needed for a job, it would be less convenient for the user to first discover the right socket from among the set of sockets and then to remove the socket by having to release the retaining strap first.

SUMMARY OF THE INVENTION

In the light of foregoing disadvantages associated with a prior art socket wrench, the present invention has for its principal object to provide a socket storage means which along with a set of sockets stored therein can be detached whole from the cavity in the handle thereby reducing the weight of the wrench for its manipulation and at the same time permitting quick access to one socket or the other from among the set of upstanding sockets from the means.

The socket wrench of the present invention has in its handle a storage cavity with an entrance opening along one side, and housed therein is an attachable socket storage means which comprises a side plate and a cover plate linked together in a L-shaped arrangement. A long and narrow guide slot along the mid longitudinal portion of the side plate serves for engagement therein of a plurality of stubs which are slidable in the slot and are adapted to be mounted on each by a socket. Since the socket storage means can be completely detached and separated from the handle cavity, there will be no hindrance to the manipulation of the wrench, and further because the sockets of all sizes are held upstanding in the holder, there will be added convenience in selecting and getting the one or the other socket needed for a job.

In the socket wrench of this type, the mounting stubs are detachably mounted on the socket holder and are slidable along the length of the slot. Accordingly, depending on the sizes of the sockets needed it is possible to adjust the spacing between different sockets as desired. For the same wrench and the associated socket holder, the socket wrench of the present invention is adaptable to a multiple set of sockets of different sizes.

Other objects and further features of the present invention will become apparent from the following detailed description taken in connection with the accompanying drawings, wherein.

Figure 1:
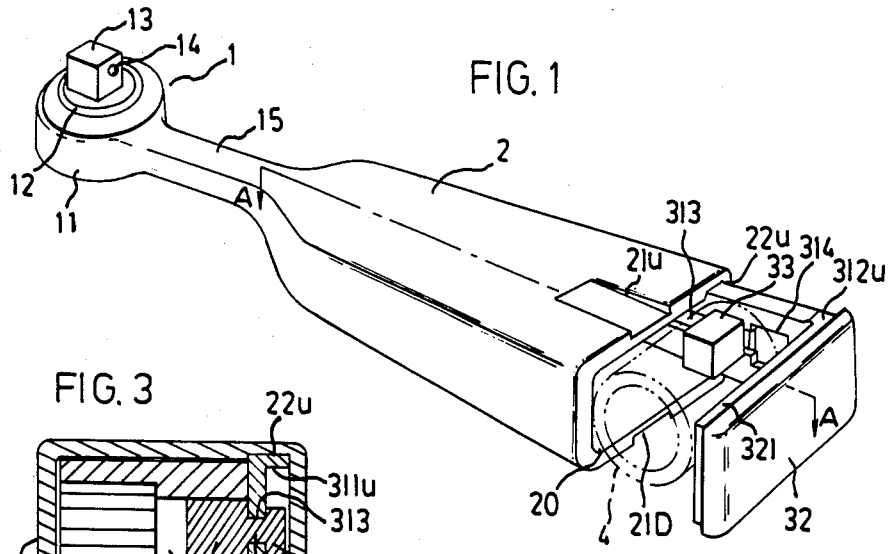
FIG. 1 is a perspective view of an embodiment of a socket wrench in accordance with the present invention, socket storage means of which being shown partly drawn out.
Figure 3:
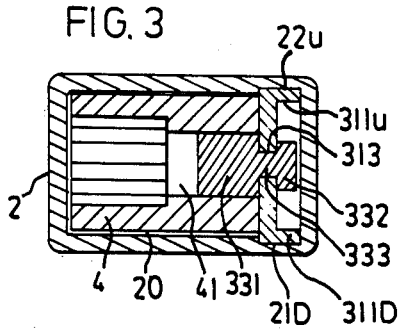
FIG. 3 is a transverse sectional view taken substantially as shown along the line B—B of FIG. 2.
Figure 2:
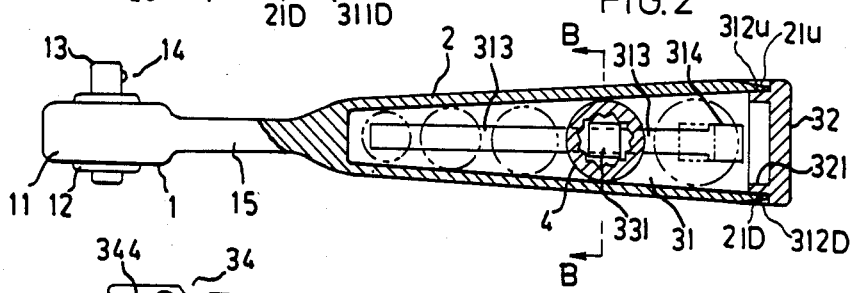
FIG. 2 is a sectional view of the socket wrench taken substantially as indicated along the line A—A of FIG. 1.

Referring to the embodiment as depicted in FIGS. 1, 2 and 3, a socket wrench of the present invention includes at its front end a wrench head 1 consisting at the circumference thereof a ring support 11 inside which is fixed a ratchet mechanism 12. Projecting out on the upper center of the ratchet mechanism 12 is mounted a rectangular socket mounting stub 13 having at one side wall provided with a lock steel ball 14 which by the outward action of a spring will press against the wall of a socket thereby fixing the latter in position, and at the bottom side provided with a control button for controlling the clockwise and the counter rotations of the ratchet mechanism. In the disclosed embodiment, a handle 2 is provided for the wrench and the wrench head 1 is integrally connected through its ring support 11 to the handle 2 by a neck 15.

The handle 2 is a hollow cylindrical body having interior walls defining a long and narrow storage cavity 20, the rear side of which is open to provide an entrance opening. On the opposite longitudinal sides of the handle 2 there are formed at appropriate places tapered slots 21U and 21D, the open ends of these slots pass to the rear end face of the handle, while at appropriate places of the storage cavity 20 are provided on the upper and lower longitudinal side walls corresponding guide grooves 22U and 22D.

Attached in the storage cavity 20 of the handle 2 there is provided a socket storage means or socket holder 3 which comprises a side plate 31, a cover plate 32 and a plurality of mounting stubs 33. The side plate 31 is shaped as an isosceles trapezoid, the upper and lower longitudinal side edges thereof being folded outwardly in an angle of approximately 90° to form stiffening lugs 311U and 311D. These stiffening lugs 311U and 311D must be adaptably received in the corresponding guide grooves 22U and 22D and movable to and fro therein. Those portions of the stiffening lugs 311U and 311D that adjoin to the cover plate 32 are further projected out slightly to form corresponding protuberances 312U and 312D respectively on each side. When the side plate 31 is completely located within the storage cavity 20, the corresponding protuberances 312U and 312D will be suitably pressing against the inner walls respectively of the guide grooves 22U and 22D. Along the central line of the side plate is formed longitudinally a long and narrow guide slot 313, and at an appropriate location adjacent to the inner side face of the cover plate 32 the guide slot 313 is enlarged to form an aperture 314. The cover plate 32 is rectangular in shape, size and outline of which may best be suited to cover the entrance opening of the handle 2. The cover plate 32 is further provided on the inside face with an inner flange 321 which, at the time the rear end of the handle 2 is covered by the cover plate 32, can be closely fitted in the tips of the opening of the storage cavity 20. In addition, this inner flange 321 of the cover plate 32 is integrally connected to the side plate 31 and together form a L-shaped structure. Each mounting stub 33 has at its front end a rectangular portion 331 which can suitably be fitted into the rectangular hole 41 of a socket member 4. At the other end of the mounting stub is a projecting portion 332 which is integrally connected to the rectangular portion 331 by a narrow neck 333. This narrow neck 333 can be closely fitted into and is movable in the guide slot 313 of the side plate 31 while the projecting portion 332 is adapted to be able to pass through the enlarged aperture 314 at the rear end of the guide slot 313.

Arrangement for disposing a plurality of mounting stubs 33 in the socket storage means is such that each stub 33 is passed through the enlarged aperture 314 by the projecting portion 332 thereof and then engaged in the guide slot 313 by the neck 333 thereof. The spacing is adjusted between the individual mounting stubs 33 according to the diameter of the socket members 4 to be used, and the sockets 4 are each mounted on to the rectangular portion 331 of each mounting stub 33 by the rectangular hole 41 at the lower side thereof. In this way, individual sockets 4 are held separately upstanding on the inside face of the side plate 31 with the serrated hole 42 of each socket member 4 facing outwardly. After the socket members 4 have been mounted on the mounting stubs separately, the socket storage means is next received in the storage cavity 20 of the handle 2 by inserting the stiffening lugs 311U and 311D at the upper and lower edges of the side plate 31 in the guide grooves 22U and 22D till the rear end face of the handle is covered by the plate 32. At this moment, the corresponding protuberances 312U and 312D of the two stiffening lugs 311U and 311D will also be pressing against the corresponding inner sides of the guide grooves 22U and 22D and the socket holder 3 is thus fixedly stored in the cavity 20 of the handle.

Figure 4:
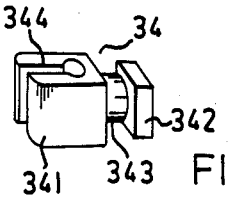
FIG. 4 is a perspective view of another embodiment of the mounting stub 33 as shown in FIG. 1.
Figure 5:
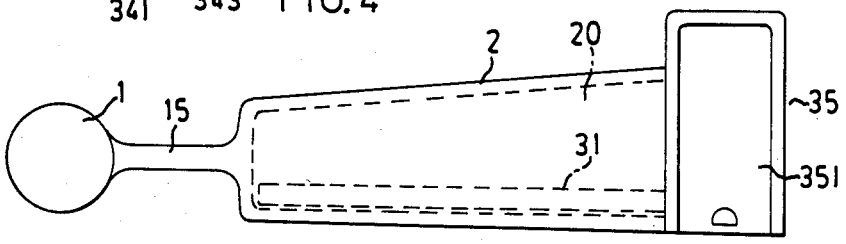
FIG. 5 is a front view of another embodiment of the socket wrench of the present invention.

FIG. 4 illustrates another embodiment of the mounting stub of the present invention, in which the mounting stub 34 comprises, in a similar manner as in an earlier embodiment, a rectangular portion 341, a projecting portion 342 and a neck 343 integrally connecting the two portions 341 and 342 together. However the rectangular portion 341 here includes a slit 344 formed therein from the side face inwardly. The two side walls of the slit 344 spread out slightly thereby permitting the rectangular portion 341 to some degree of elasticity and the socket member 4 fixed in position when the socket 4 is mounted by its rectangular hole on the surrounding of that rectangular portion. Now, the drawing in FIG. 5 shows the socket storage means 3 of the present invention in still another embodiment. In this embodiment, the rear end of the socket storage means 3 is connected to the side plate 31 in a L-shaped structure which ends in a box member 35 having a lid 351 at one side wall thereof. A wall of the box member 35 defines the cover plate 32 for use in covering the entrance opening to the storage cavity 20 of the handle. The box serves as another storage means to receive therein any special socket or a socket of larger size and can of course be used to store other outfit.

From the foregoing detailed description, it will be seen that the socket wrench of the invention is not only easy in carrying about and manipulating in a job, because spacing of the mounting stubs for use in fixing the sockets in position can be adjusted at will, it is also adaptable to hold a multiple set of sockets of different sizes thereby reducing the cost in manufacture, assembly and packaging.

I claim:

1. A socket wrench with an attachable socket storage means, comprising:

a head carrying a socket mounting stub, a longitudinally extending handle provided with a storage cavity therein for housing said attachable socket storage means, and a neck integrally connecting said head and handle together, said attachable socket storage means being longitudinally slidable relative to said handle and comprising:

a side plate and a cover plate connected together to form an L-shaped structure wherein said plate is longitudinally slidable within said cavity and is provided with a narrow, longitudinally elongate guide slot, said slot having one end thereof formed with an enlarged aperture, and a plurality of mounting stubs for carrying sockets, each stub comprising:

a rectangular portion for mating with a rectangular hole in a socket, a projecting portion, and a narrow neck integrally connecting said rectangular and projecting portions together such that said projecting portion is insertable through said enlarged aperture to slidably disposed said neck within said slot.

2. A socket wrench according to claim 1, including a storage box mounted on said side plate so as to be situated outside of said cavity, a wall of said storage box defining said cover plate.

3. A socket wrench with an attachable socket storage means, comprising:

a head carrying a socket mounting stub, a longitudinally extending handle provided with a storage cavity therein for housing said attachable socket storage means, a neck integrally connecting said head and handle together, said attachable socket storage means being longitudinally slidable relative to said handle and comprising:

a side plate and a cover plate connected together to form an L-shaped structure wherein said plate is longitudinally slidable within said cavity and carries a plurality of mounting stubs for carrying sockets, said stubs each including a rectangular portion for mating with a rectangular hole of a socket, said rectangular portion containing a slit to render said rectangular portion elastic so as to yieldably press against a wall of the rectangular hole of the socket in order to secure the socket in place.

4. A socket wrench according to claim 3, including a storage box mounted on said side plate so as to be situated outside of said cavity, a wall of said storage box defining said cover plate.

* * * * *